US006969543B1

(12) United States Patent
Aronhime et al.

(10) Patent No.: US 6,969,543 B1
(45) Date of Patent: Nov. 29, 2005

(54) INTERMEDIATE TRANSFER BLANKET AND METHOD OF PRODUCING THE SAME

(75) Inventors: Marc Aronhime, Rehovot (IL); Frida Avadic, Rishon L'Tzion (IL); David Idan, Ashdod (IL); Nava Klein, Rishon L'Tzion (IL); Yael Kowal, Tel Aviv (IL); Benny Landa, Nes Ziona (IL); Amiran Lavon, Bat Yam (IL); Yehuda Niv, Nes Tziona (IL); Carlos Teper, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/011,634

(22) PCT Filed: Aug. 16, 1996

(86) PCT No.: PCT/NL96/00323

§ 371 (c)(1),
(2), (4) Date: Apr. 3, 1998

(87) PCT Pub. No.: WO97/07433

PCT Pub. Date: Feb. 27, 1997

(30) Foreign Application Priority Data

Aug. 17, 1995 (IL) ..... 114992

(51) Int. Cl.[7] ..... B41M 5/00

(52) U.S. Cl. ..... 428/32.5; 101/379; 399/302; 399/308; 428/218; 428/909

(58) Field of Search ..... 428/195, 32.51, 428/218, 909; 430/32, 48, 127, 132; 101/379; 118/264, 265; 399/302, 308

(56) References Cited

U.S. PATENT DOCUMENTS

| | | | | |
|---|---|---|---|---|
| 3,862,848 | A | 1/1975 | Marley | |
| 3,893,761 | A | 7/1975 | Buchan et al. | |
| 3,983,287 | A | 9/1976 | Goossen et al. | |
| 4,066,802 | A * | 1/1978 | Clemens | 427/24 |
| 4,074,001 | A * | 2/1978 | Imai et al. | 428/329 |
| 4,093,487 | A | 6/1978 | Gaworowski et al. | |
| 4,112,841 | A | 9/1978 | Deshpande | |
| 4,114,535 | A | 9/1978 | Deshpande | |
| 4,216,252 | A * | 8/1980 | Moeller | 427/387 |
| 4,511,622 | A * | 4/1985 | Seimiya et al. | 428/323 |
| 4,531,825 | A | 7/1985 | Miwa et al. | |
| 4,532,175 | A * | 7/1985 | Johnson et al. | 428/220 |

(Continued)

FOREIGN PATENT DOCUMENTS

DE 4426820 A * 2/1995 ..... B41C 1/055

(Continued)

OTHER PUBLICATIONS

Patent Abstracts of Japan, vol. 012, No. 185 (P-170), May 1988.

*Primary Examiner*—B. Hamliton Hess

(57) ABSTRACT

A multi-layered image transfer blanket and a method of producing same, including a body portion and an image transfer portion, the image transfer portion having an image transfer surface and a back surface, comprising forming the image transfer portion on a carrier substrate and transferring the image transfer portion onto the body portion such that the back surface of the image transfer portion faces the body portion. Preferably, the image transfer portion is formed on the carrier substrate such that the back surface of the image transfer portion faces the carrier substrate.

24 Claims, 4 Drawing Sheets

U.S. PATENT DOCUMENTS 4,595,602 A * 6/1986 Schank ..... 427/76
4,600,673 A * 7/1986 Hendrickson et al. ..... 430/66
4,684,238 A 8/1987 Till et al.
4,690,539 A 9/1987 Radulski et al.
4,935,300 A 6/1990 Parker et al.
4,984,025 A 1/1991 Landa et al.
5,012,291 A 4/1991 Buchan et al.
5,047,808 A 9/1991 Landa et al.
5,089,856 A 2/1992 Landa et al.
5,103,263 A 4/1992 Moore et al.
5,114,520 A * 5/1992 Wang, Jr. et al. ..... 156/240
5,114,814 A * 5/1992 Sakoh et al. ..... 430/46
5,213,899 A 5/1993 Lucas
5,227,850 A 7/1993 Sato et al.
5,276,492 A 1/1994 Landa et al.
5,335,054 A 8/1994 Landa et al.
5,340,679 A * 8/1994 Badesha et al. ..... 430/126
5,356,987 A 10/1994 Stephenson
5,370,931 A 12/1994 Fratangelo et al.
5,413,809 A 5/1995 Hazan
5,430,002 A 7/1995 Tamura et al.
5,431,989 A * 7/1995 Beltzung et al. ..... 428/218
5,497,222 A 3/1996 Landa et al.
5,576,818 A 11/1996 Badesha

FOREIGN PATENT DOCUMENTS

EP 0399186 11/1990
EP 0399794 11/1990
EP 0534472 3/1993
EP 0584893 3/1994
EP 0638854 2/1995
JP 50-46037 4/1975
JP 57-19753 * 2/1982 ..... G03G 7/00
JP 57-020742 * 2/1982 ..... G03G 7/00
JP 62293270 12/1987
WO 90/04216 4/1990
WO 90/14619 11/1990
WO 91/03007 3/1991
WO 91/14393 10/1991
WO 96/11426 4/1996
WO WO 96/14619 5/1996
WO 97/07433 2/1997

* cited by examiner

FIG. 4
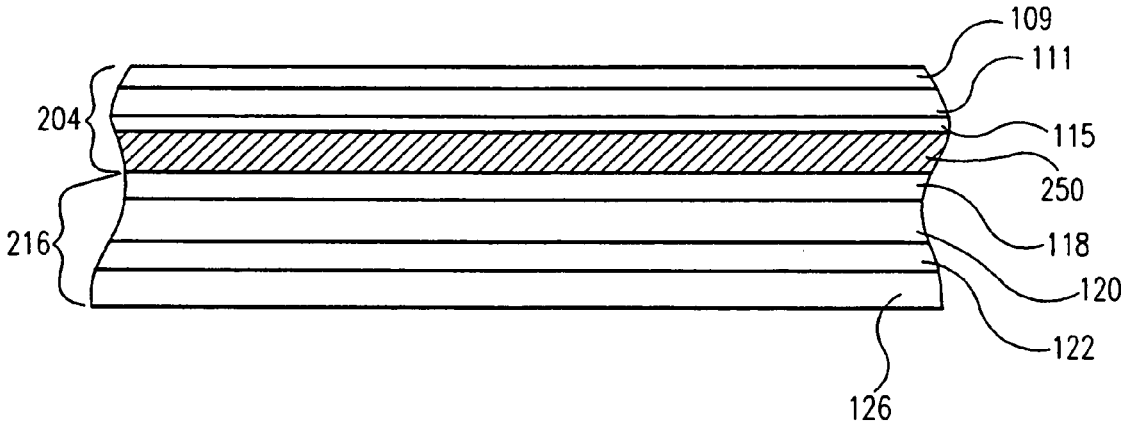
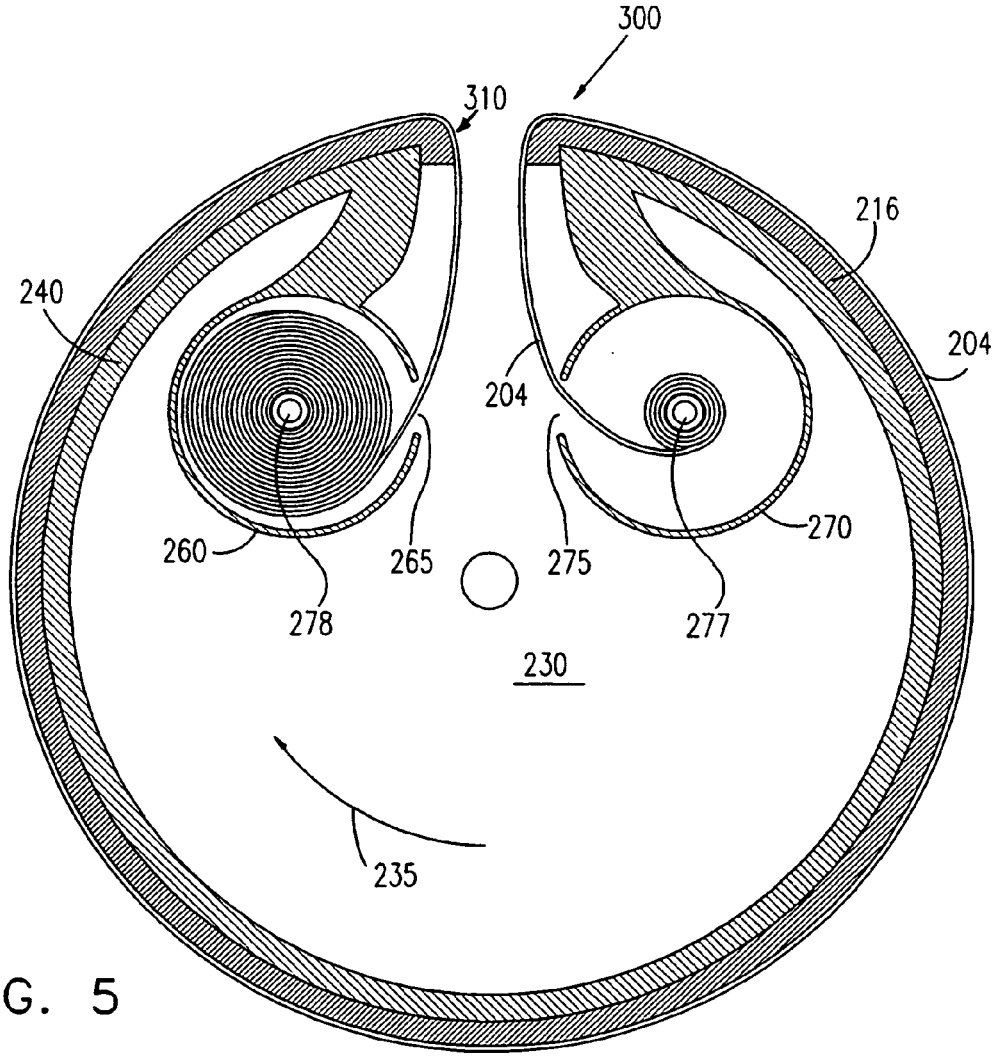
FIG. 5

INTERMEDIATE TRANSFER BLANKET AND METHOD OF PRODUCING THE SAME

FIELD OF THE INVENTION

The present invention relates to improved intermediate transfer blankets, especially suited for transfer of liquid toner images, and methods of producing such blankets.

BACKGROUND OF THE INVENTION

The use of an intermediate transfer member in electrostatic imaging is well known.

Various types of intermediate transfer members are known and are described, for example in U.S. Pat. Nos. 3,862,848, 4,684,238, 4,690,539 and 4,531,825, the specifications of all of which are incorporated herein by reference.

Belt-type intermediate transfer members for use in electrophotography are known in the art and are described, inter alia, in U.S. Pat. Nos. 3,893,761, 4,684,238 and 4,690,539, the specifications of all of which are incorporated herein by reference.

The use of intermediate transfer members and members including transfer blankets, for offset ink printing, is also well known. Such blankets have characteristics which are suitable for ink transfer but they are generally not usable, per se, for liquid toner imaging.

Multi-layered intermediate transfer blankets for toner imaging are known in the art. Generally, such blankets include a thin, multi-layered, image transfer portion and a base (or body) portion which supports the image transfer portion and provides the blanket with resilience during contact with an imaging surface and/or a final substrate. While the process for producing the image transfer portion is a relatively clean process, the base portion is generally not compatible with such clean processes.

Mechanisms for continuous replacement of an imaging blanket are known in the art. Such a mechanism is described, for example in Japanese Publication JP 5046037, published Feb. 26, 1993, wherein a continuous sheet of transfer-blanket material is rolled-up in a cassette, inside a drum, and a premeasured length of the blanket material is stretched circumferentially on the surface of the drum. When the stretched out length of blanket requires replacement, the used portion of the blanket is drawn into a take-up cassette, inside the drum, and a new portion of the blanket is stretched between the two cassettes. It should be noted that the length of transfer-blanket material in the cassettes is limited by the thickness of the continuous blanket and the available space within the drum.

U.S. Pat. No. 4,074,001 describes a fixing roller for electrophotography which has a 3 mm coating of a mixture of diorganopolysiloxanes terminated at both chain ends with diorganohydroxysilyl groups bonded to terminal silicone atoms (a condensation type silicone), diorganopolysiloxanes terminated at both chain ends with trialkysilyl groups (a substantially unreactive silicone oil), a minor part of an alkoxysilane catalyst and various amounts of fillers. This material vulcanizes, in the 3 mm thickness, at room temperature.

SUMMARY OF THE INVENTION

It is an object of an aspect of the present invention to provide an improved image transfer blanket for use as part of an image transfer member in imaging apparatus, especially in image forming apparatus using electrostatically charged toner.

It is an object of an aspect of the present invention to provide an improved method and apparatus for producing a multi-layered image transfer blanket.

It is an object of an aspect of the present invention to provide an image transfer blanket having a base portion and an image transfer portion, wherein the image transfer portion is movable relative to the base portion.

It is an object of an aspect of the present invention to provide a mechanism for replacing the image transfer portion of the image transfer blanket without replacing the base portion of the blanket.

It is a further object of some aspects of the invention to provide an improved release layer for intermediate transfer members and blankets.

There is thus provided, in accordance with a preferred embodiment of the invention, a method of producing a multi-layered image transfer blanket including a body portion and an image transfer portion, the image transfer portion having an image transfer surface and a back surface, comprising:

forming the image transfer portion on a carrier substrate; and transferring the image transfer portion onto the body portion such that the back surface of the image transfer portion faces the body portion.

Preferably the image transfer portion is formed on the carrier substrate such that the back surface of the image transfer portion faces the carrier substrate.

In a preferred embodiment of the invention transferring the image transfer portion comprises:

transferring the image transfer portion to a moving carrier surface, such that at least a portion of the image transfer surface is in contact with the moving surface; and laminating the image transfer portion onto the body portion such that the back surface of the image transfer portion faces the body portion.

Preferably the method comprises curing at least one of the layers in said multi-layered blanket after transferring the image transfer portion. Preferably, the image transfer blanket comprises a polymer layer, preferably a conducting layer, interfacing the back surface of the image transfer portion and curing at least one of the layers comprises curing the polymer layer after laminating the image transfer portion onto the body portion.

In one preferred embodiment of the invention the polymer layer is part of the body portion. Additionally or alternatively, the polymer layer is part of the image transfer portion.

In a preferred embodiment of the invention the image transfer portion comprises a release layer at the image transfer surface and a conforming layer and wherein curing at least one layer comprises curing the release layer and the conforming layer before laminating the image transfer portion to the body portion. In an alternative preferred embodiment of the invention the release layer and the conforming layer are cured after laminating the image transfer portion to the body portion.

In a preferred embodiment of the invention forming the image transfer portion comprises coating the carrier substrate with a conforming layer.

In a preferred embodiment of the invention forming the image transfer portion comprises coating the carrier substrate with a barrier layer.

In a preferred embodiment of the invention forming the image transfer portion comprises coating the carrier substrate with a conductive layer.

In a preferred embodiment of the invention the conforming layer comprises a plurality of layers of different hardnesses.

In a preferred embodiment of the invention forming the image transfer portion comprises overcoating the conforming layer with a release layer, preferably comprising a layer of condensation type silicone.

There is further provided in accordance with a preferred embodiment of the invention an image transfer member suitable for the transfer of toner images and having a non-tacky outer release coating of a condensation type silicone.

Preferably the release layer has a thickness of less than 1 mm, more preferably less than 500 micrometers, even more preferably less than 100 micrometers and most preferably between 3 and 15 micrometers thick.

Further, the release layer preferably has less than 4% filler, more preferably less than 1% filler, even more preferably less than 0.1% filler.

In a preferred embodiment of the invention the outer release layer contains less than 10% silicone oil, more preferably less than 5% silicone oil, more preferably less than 1% silicone oil, most preferably little or no silicone oil.

In a preferred embodiment of the invention the outer release layer contains added crosslinker.

In a preferred embodiment of the invention the outer release layer contains added catalyst.

In a preferred embodiment of the invention the outer release layer contains added conductive material.

In a preferred embodiment of the invention adhesion of the outer release coating to the image transfer member is enhanced utilizing primer.

There is further provided, in accordance with a preferred embodiment of the invention, apparatus for producing a multi-layered image transfer blanket including a body portion and an image transfer portion, the image transfer portion having an image transfer surface and a back surface, comprising:

- a carrier substrate having the image transfer portion formed thereon such that the back surface of the image transfer portion faces the carrier substrate and is releasable therefrom; and
- a moving carrier surface, in contact with a portion of the image transfer surface, which receives the image transfer portion from the carrier substrate, at a first transfer region, and laminates the image transfer portion onto the body portion, at a second transfer region, with the back surface of the image transfer portion facing the body portion.

Preferably, the apparatus further comprises a curing device which cures at least one of the layers in said multi-layered blanket.

There is further provided, in accordance with a preferred embodiment of the invention, an image transfer blanket comprising:

- a transfer surface adapted to receive already formed images; and
- a conforming layer substantially immediately beneath the release surface which comprises a plurality of sub-layers each having a Shore A hardness of less than 80, preferably less than 70, more preferably less than 60.

Preferably, the sub-layers comprise at least two sub-layers, a relatively harder one of said sub-layers being situated between is between the release surface and a relatively softer one of said sub-layers. Preferably, the relatively softer sub-layer has a Shore A hardness of less than 42, less than 35, or less than 25. Preferably, the relatively harder sub-layer has a Shore A hardness of greater than 42, or greater than 50. In some preferred embodiments of the invention the ratio of the thickness of the relatively harder sub-layer to the thickness of the relatively softer sub-layer is about 1:4.

There is further provided an image transfer blanket comprising:

- a body portion including a layer of resilient material; and
- a multi-layered transfer portion having an image transfer surface and including a supporting base layer which is formed of a substantially non-compliant material,
- wherein the supporting base layer of the transfer portion interfaces the body portion.

There is further provided in accordance with a preferred embodiment of the invention a method of producing a multi-layered image transfer blanket comprising:

- forming a multi-layered image transfer portion having an image transfer surface and a supporting base layer, the base layer being formed of a substantially non-compliant material; and
- attaching the image transfer portion to a body portion including a layer of substantially resilient material,
- wherein the supporting base layer of the transfer portion interfaces the body portion.

There is further provided, in accordance with a preferred embodiment of the invention an intermediate transfer member, which receives a toner image from an imaging surface and from which it is subsequently transferred, comprising:

- a drum; and
- an image transfer blanket mounted on the drum, the image transfer blanket comprising:
- a body portion including a layer of resilient material; and
- a multi-layered transfer portion having an image transfer surface which receives the toner image and a supporting base layer which is formed of a substantially non-compliant material,
- wherein the supporting base layer of the transfer portion interfaces the body portion.

Preferably, the supporting base layer comprises a layer of Kapton.

There is further provided an intermediate transfer member, which receives a toner image from an imaging surface and from which it is subsequently transferred, comprising:

- a drum;
- a resilient blanket body mounted circumferentially on the surface of the drum and having a functional length;
- a sheet of image transfer material having first and second ends and having a length equal to at least twice the functional length of the blanket body;
- a transfer material supply member associated with the first end of the sheet; and
- a transfer material take-up member associated with the second end of the sheet,
- wherein an appropriate length of the sheet is stretched between the supply member and the take-up member, over the functional length of the blanket body.

Preferably, a predetermined length of used-up sheet is taken-up by the take-up member and replaced with approximately the same length of unused sheet which is supplied the supply member.

There is further provided a carrier substrate having formed thereon a multi-layered image transfer arrangement, the image transfer arrangement comprising a back surface and an image transfer surface, wherein the back surface of the image transfer arrangement faces the carrier substrate and is removably attached thereto.

BRIEF DESCRIPTION OF THE DRAWINGS

The present invention will be understood and appreciated more fully from the following detailed description, taken in conjunction with the drawings in which:

FIG. 4 is a simplified, schematic illustration of an image transfer blanket having an image transfer portion, constructed in accordance with another, preferred, embodiment of the present invention; and FIG. 5 is a simplified cross-sectional illustration of an image transfer member, including the image transfer blanket of FIG. 4 mounted on a drum and apparatus for renewing the image transfer portion of the image transfer blanket, constructed and operative in accordance with a preferred embodiment of the invention.

DETAILED DESCRIPTION OF PREFERRED EMBODIMENTS

Figure 1:
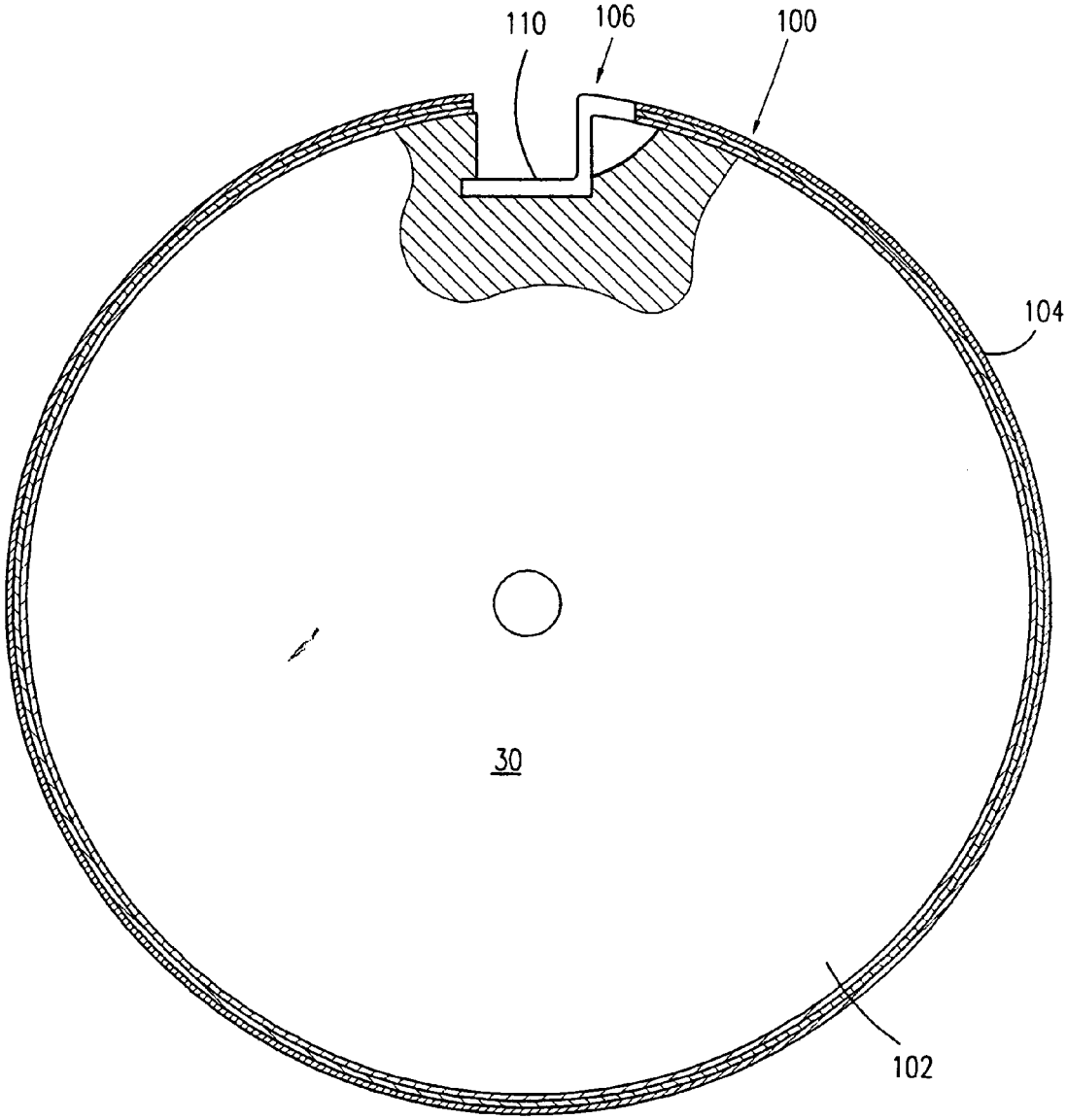
FIG. 1 is a simplified cross-sectional illustration of an image transfer member, including a multi-layered image transfer blanket mounted on a drum, in accordance with a preferred embodiment of the present invention.

Reference is now made to FIG. 1 which is a simplified cross-sectional illustration of an image transfer member 30, including a multi-layered image transfer blanket 100 mounted on a drum 102, in accordance with a preferred embodiment of the present invention. Image transfer member 30 may, for some embodiments of the invention, be any suitable intermediate transfer member having a multilayered transfer portion such as those described below or in U.S. Pat. No. 5,089,856 or 5,047,808 or in PCT Application PCT/NL 95/00188, filed Jun. 6, 1995, the disclosures of which are incorporated herein by reference and by other structures known in the art. As is known in the art, member 30 is maintained at a suitable voltage and temperature for electrostatic transfer of a toner image thereto from an image bearing surface, such as a photoreceptor surface. The image is preferably transferred from intermediate transfer member 30 onto a final substrate (not shown), such as paper, preferably by heat and pressure. For the preferred toner described in PCT/NL 95/00188, an image temperature of about 95° C. at the inception of fusing is preferred.

Certain aspects of the present invention, especially the manner in which transfer blanket 100 is mounted on drum 102, are shown and described by way of example only and may vary in accordance with specific requirements and design considerations. Other preferred methods of mounting the transfer blanket on the drum are shown in the aforementioned application number PCT/NL 95/00188.

As known in the art, a plurality of single color images are preferably sequentially transferred, in mutual alignment, to the surface of an image transfer portion 104 of image transfer blanket 100, by sequential imaging cycles. When all of the desired images have been transferred to image transfer blanket 100, the complete multi-color image is transferred from transfer member 30 to the final substrate. Alternatively, each single color image may be separately transferred to the substrate via the intermediate transfer member, as known in the art.

Figure 2A:
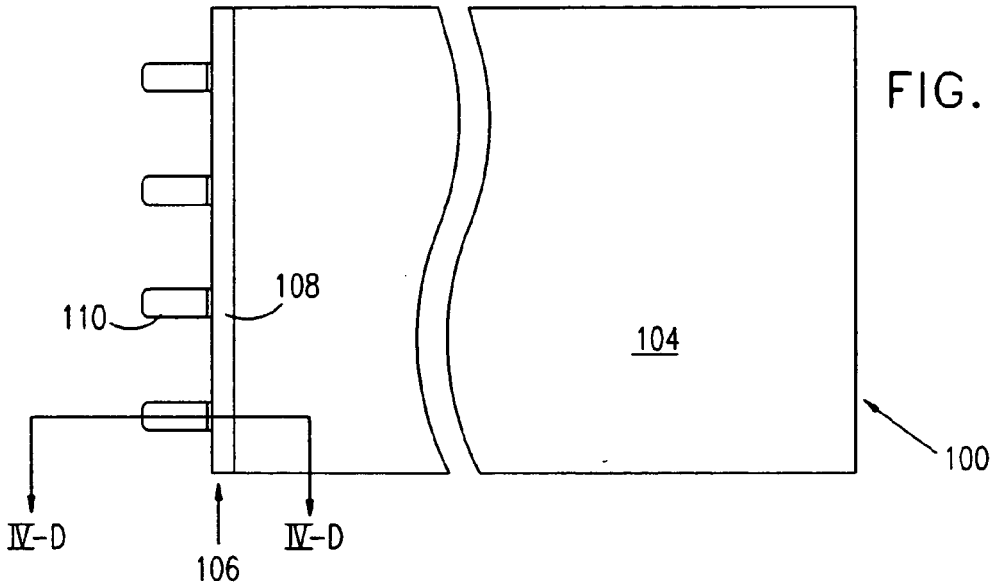
FIGS. 2A and 2B are respective top and side views of the image transfer blanket of FIG. 1, in accordance with a preferred embodiment of the present invention.
Figure 2B:
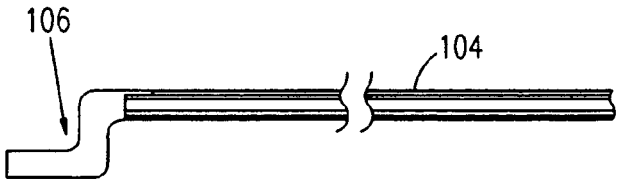
Figure 2C:
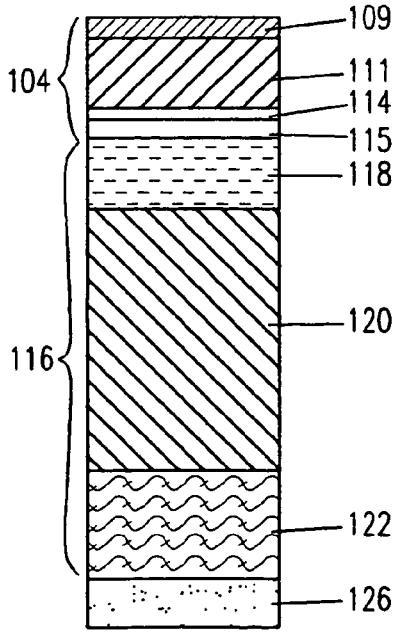
FIG. 2C shows details of the multi-layered construction of the image transfer blanket of FIGS. 2A and 2B, in accordance with one, preferred, embodiment of the present invention.

Reference is now made to FIGS. 2A, 2B and 2C which schematically illustrate a preferred embodiment of image transfer blanket 100. As shown most clearly in FIG. 2C, image transfer portion 104 comprises a release layer 109 which is outermost on the blanket when it is mounted on drum 102. Underlying layer 109 is a conforming layer 111 preferably of a soft elastomer, preferably of polyurethane or acrylic and preferably having a Shore A hardness of less than about 65, more preferably, less than about 55, but preferably more than about 35. A suitable hardness value is between about 42 and about 45. Alternatively, layer 11 may have sub-layers of varying hardness, as described below.

A thin barrier layer for solvents and/or gases 114 lies between layer 111 and an underlying conductive layer 115 for some embodiments of the invention. In general, the order of layers 114 and 115 may be reversed. Conductive layer 115 overlays a blanket body 116 comprising a top layer 118, a compressible layer 120 and a fabric layer 122. In a preferred embodiment of the invention, as described in more detail below, top layer 118 is conductive and conductive layer 115 may be omitted.

Underlying the fabric layer there may be an adhesive layer 126 which is in contact with drum 102. Alternatively, layer 126 is a very soft, smooth, layer.

Drum 102 is preferably heated by an internal halogen lamp heater or other heater to aid transfer of the image to the release layer 109 and therefrom to the final substrate, as is well known in the art. Other heating methods, or no heating at all, may also be used in the practice of the invention. The degree of heating will depend on the characteristics of the toner and/or ink used in conjunction with the invention.

As shown in FIGS. 2A and 2B, mounting fitting 106 comprises an elongate electrically conducting bar 108, for example of a metal such as aluminum, formed with a series of L-shaped mounting legs 110 (in the form of finger-like extensions) which are also conducting, preferably of the same material as bar 108, and preferably formed integrally therewith. In particular, bar 108 is formed, in one preferred embodiment, with a slot into which the end of layered part of blanket 100 is inserted. Preferably, the end of the layered part which is inserted into the mounting bar does not include release layer 109, conforming layer 111 and barrier layer 114, whereby conducting layer 115 is exposed and is therefore in electrical contact with bar 108.

Alternatively, if layer 118 is conducting or layer 115 is made thick enough (preferably more than 40 micrometers thick) the slot can be formed with sharp internal projections which pierce the outer layers of the blanket and contact conducting layer 115 or conducting top layer 118.

Optionally, each of the layers beneath conducting layer 115 may be partially conducting (for example, by the addition of conductive carbon black or metal fibers) and the adhesive (or very soft and smooth) layer 126 may be conductive, such that current flows, additionally or alternatively, directly from the drum surface to the conducting layer. In this case layer 115 may generally be omitted.

Optionally, the conforming layer and/or the release layer are made somewhat conductive (preferably between $10^6$ and $10^{12}$ ohm-cm, more preferably, between $10^9$ and $10^{11}$ ohm-cm) by the addition of carbon black or between 1% and 10% of anti-static compounds such as CC-42 (Witco).

For the purposes of most aspects of the present invention, the structure and method of attachment of the blanket to drum 30 is not relevant, per se, to the invention.

In one preferred embodiment of the invention, fitting 106 is formed of a single sheet of metal, wherein the legs are partially cut from the metal which is bent into a U-shape to form the slot into which the layered portion is inserted. After insertion, the outer walls of the slot are forced against the layered portion to secure the layered portion in the slot and, optionally, to pierce the outer surface of the blanket and contact the conductive layer. The partially cut out portion is bent to form the mounting legs.

In the preferred embodiment of the invention, drum 102 is maintained at a potential suitable for transferring images to the intermediate transfer member, for example at a negative voltage of 500 volts, which voltage is applied, via mounting fitting 106 to conductive layer 115 or 118. Thus, the source of transfer voltage is very near the outer surface of transfer portion 104 which allows for a lower transfer potential on the drum.

Apart from differences which will be appreciated from the descriptions herein, the multi-layered blanket 100 of the present invention is generally similar to that described in PCT/NL 95/00188, except for additional preferred embodiments as described herein. However, the multi-layered blanket of the present invention is produced by a new process, as described below.

It is appreciated that blanket body 116 includes components which may contaminate at least some of the layers in the image transfer portion during production of the blanket. For example, small particles from blanket body 116, which is generally formed of relatively unclean materials, may break off the body portion and contaminate the relatively clean layers of transfer portion 104. This may result in low transfer efficiency and poor imaging quality. Therefore, in a preferred embodiment of the present invention, blanket body 116 and image transfer portion 104 are formed separately. The separately formed image transfer portion is consequently laminated onto the blanket body, as described in detail below with reference to FIG. 3. Conducting layer 115 may be coated directly on blanket body 116 or laminated thereon together with the other layers of image transfer portion 104, as described below. Alternatively, layer 118 is conducting and layer 115 is omitted. Curing of the different layers in the multi-layered blanket may be performed before, after or during lamination of the two portions of the blanket.

Figure 3:
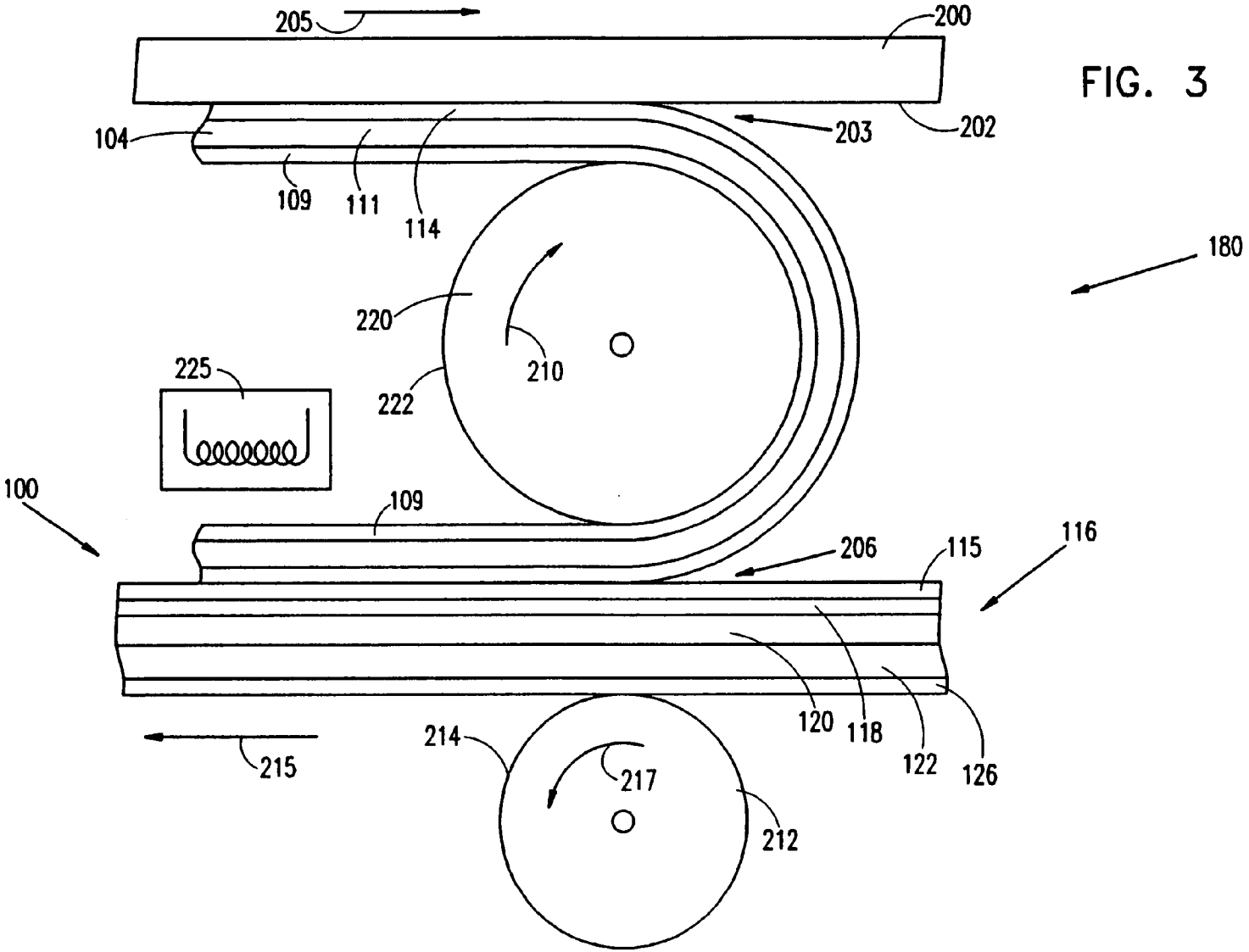
FIG. 3 is a schematic illustration of apparatus for producing a multi-layered image transfer blanket, constructed and operative in accordance with a preferred embodiment of the present invention.

Reference is now made also to FIG. 3 which schematically illustrates apparatus 180 for forming multi-layered image transfer blanket 100, constructed and operative in accordance with a preferred embodiment of the invention.

In a preferred embodiment of the invention, the construction of blanket 116 is generally similar to that described in PCT/NL 959/0018. One suitable body is MCC-1129-02 manufactured and sold by Reeves SpA, Lodi Vecchio (Milano), Italy. Other preferred blanket types are described in U.S. Pat. Nos. 5,047,808; 4,984,025; 5,335,054 and PCT publications WO 91/03007; WO 91/14393; WO 90/14619; and WO 90/04216, which are incorporated herein by reference, and in PCT/NL 95/00188. Body portion 116 includes fabric layer 122, preferably formed of woven NOMEX material having a thickness of about 200 micrometers, compressible layer 120, preferably comprising about 400 micrometers of saturated nitrile rubber loaded with carbon black to increase its thermal conductivity. Layer 120 preferably contains small voids (about 40–60% by volume) and top layer 118 is preferably formed of the same material as the compressible layer, but without voids. Blanket body 116 can be produced using production methods as are generally used for the production of offset printing blankets for ink offset printing.

Blanket body 116 is preferably sized to a relatively exact thickness by abrading portions of the surface of top layer 118. A preferred thickness for the finished body 116 is about 700 micrometers, although other thicknesses are useful, depending on the geometry of the printing system in which it is used and the exact materials used in the blanket body.

The fabric side of blanket body 116 may be coated with a 30 micrometer thick coating of silicone based adhesive (preferably, Type Q2-7566 manufactured by Dow Corning). The adhesive is covered with a sheet of mylar coated with a fluorosilicone material, such as DP 5648 Release Paper (one side coat) distributed by H.P. Smith Inc., Bedford Park, Ill. This adhesive is characterized by its good bond to the surface of drum 102 and its resistance to the carrier liquid used in the liquid toner. The blanket may be removed from drum 102, when its replacement is desired, by cutting the blanket along the edge of fitting 106 and removing the blanket and fitting.

An adhesive is preferably used to assure good thermal contact between the back of the blanket and the drum on which it is mounted. A silicone adhesive is preferred since adhesives normally used in attachment of blankets to drums in the printing art deteriorate under the heat which is generated in the underlying drum in the preferred apparatus. While the temperature of the drum varies, depending on the thermal resistance of the blanket and the desired surface temperature of the blanket (which in turn depends on the toner used in the process and the details of transfer of the toner to the final substrate), the drum temperature may reach 80° C., 100° C., 120° C. or 150° C. or more.

As an alternative to, or additional to, the adhesive layer 126, a very soft conforming layer may be used at the back of the blanket. A soft layer of this type will allow for good thermal contact between the blanket and the heated drum 102 so that the temperature of the drum need not be excessive in order for the outer surface of the blanket to reach its operating temperature. Furthermore, such a soft layer, especially if it is very soft, will cause the blanket to "cling" to the drum obviating the use of adhesive under certain circumstances. Furthermore, when the blanket is replaced there is no adhesive residue on the drum to be removed.

A very soft layer may be produced by the following method:

1) 100 g of Hi-Temp 4051 EP (Zeon) acrylic resin is mixed with 2 g NPC-50 crosslinker (Zeon) and 3 g sodium stearate and dissolved in toluene to give a solution of 15% non-volatile solids. Optionally, up to about 40 g of carbon black Pearls 130 (Cabot) is added.
2) A thin layer of the solution is coated onto release coated mylar and dried. This process is repeated several times until a thickness of preferably 20–30 micrometers is achieved.
3) The uncured resin is laminated to the adhesive layer of a blanket produced in accordance with the invention, or directly to the fabric layer. This step is preferably carried out prior to the cure of the release layer.
4) The laminated structure is cured together with the release layer and the release coated mylar is removed.

The very soft conforming layer has a Shore A hardness of about 20–24 without carbon black and about 40–45 with carbon black. Softer materials are also suitable; however, substantially harder materials do not adhere well to the drum surface. Optionally, the trailing end of the blanket is not coated with the very soft layer. The trailing edge is coated with an adhesive to improve adhesion between this portion and the drum or other surface to which it is attached. This is especially desirable when somewhat harder materials are used for the very soft layer.

The acrylic material may be replaced by other soft elastomer materials such as soft polyurethane or nitrile rubber. Other heat improving additives which have a smaller effect on the hardness of the final product may be used instead of carbon black, such as $Fe_2O_3$ or alpha aluminum oxide.

Top layer 118 is preferably coated with a sub-micron layer of primer before being coated with additional layers. A preferred primer is Dow Corning 1205 Prime Coat. The type of primer depends on the properties of the top layer and of the conductive layer. Preferably, 0.3 micron of primer is coated onto a clean top layer with a No. 0 bar in a wire-rod coating apparatus and is allowed to dry before applying the conductive layer.

Conductive layer 115 is preferably formed of an acrylic rubber loaded with conductive carbon black. The conductive layer is formed by first compounding 300 grams of Hytemp 4051EP (Zeon Chemicals) with 6 grams of Hytemp NPC 50 and 9 grams of sodium stearate in a two-roll mill for 20 minutes; and then dissolving 150 grams of the compounded material in 2000 grams of methyl ethyl ketone (MEK) by stirring for 12 hours at room temperature.

48 grams of conductive carbon black, such as, for example, Printex XE2 (Degussa) are added to the solution and the mixture is ground in a 01 attritor (Union Process) loaded with 3/16" steel balls. Grinding proceeds at 10° C. for 4 hours after which time the material is diluted by the addition of MEK to a concentration of 7.5–8% solids and discharged from the grinder in the form of a conductive lacquer.

This material is coated onto layer 118 to a thickness of preferably 1–3 micrometers.

In an alternate preferred embodiment of the invention, where a thicker conductive layer is desired for attachment to bar 108 by way of piercing elements, layer 118 is made conductive and layer 115 is omitted. For this embodiment a different conductive formulation is preferably used, which formulation is prepared as follows:

1) 100 g of Hi-Temp 4051 EP (Zeon) acrylic resin and 15–25 grams of Printex XE-2 carbon black (Degussa) are mixed on an unheated two-roll mill or Bumbury mixer for 2–4 minutes.
2) 2 g NPC-50 crosslinker (Zeon) and 3 g sodium stearate are added to the mixture on the two roll mill and mixing is continued for 4–10 minutes. The mill is kept cool to avoid premature polymerization of the acrylic resin.
3) The resulting mixture is dissolved and dispersed in toluene are to give a mixture containing 17% to about 30% non-volatile solids.
4) The resultant mixture is progressively filtered, with a final filtering stage of 50 micrometers.

Layer 120 is overcalled with about 100 micrometers of the resulting material and is dried at up to 100° C. for a few minutes. Several layers of this material are added until the desired thickness of 100 micrometers is reached. This layer is sized as described above. The resulting conductive layer preferably has a resistance of 15K ohms per square to 50K ohms per square.

An additional coating of primer may be added over the conductive lacquer or the conductive top layer 118 (except for the portion which is to be inserted into bar 108) before the remaining layers, i.e. the layers of image transfer portion 104, are laminated onto blanket body 116. Conductive layer 115 is preferably not cured until after lamination with portion 104, as described below.

The resistance of the conductive layer should preferably be more than about 15–20K ohms per square and preferably less than about 50K ohms per square. This value will depend on the resistivity of the layers above the conducting layer and on the aspect ratio of the blanket. In general, the resistance should be low enough so that the current flowing on the conducting layer (to supply leakage current through the overlying layers) does not cause a substantial variation of voltage along the surface of the blanket. The resistance of the conducting layer and, more importantly, the resistance of the overlying layers control the current flowing through the overlying layers. Generally speaking, the conductive layer has a relatively low resistance and resistivity, the conforming layer (layer 111) has a higher resistivity and the overlying release layer (layer 109) has a still higher resistivity.

As shown in FIG. 3, image transfer portion 104 is preferably formed on a carrier substrate 200 independently of the formation of blanket body 116 as described above. The utilized surface 202 of substrate 200 should be releasable from conforming layer 111, barrier layer 114 or conducting layer 115 (depending on whether barrier layer 114 and/or conductive layer 115 are included in image transfer portion 104), because portion 104 is to be subsequently removed from substrate 200. Furthermore, the releasability of substrate 200 from portion 104 should be higher than the releasability of release layer 109 from conforming layer 111, to ensure that the layers in portion 104 are collectively releasable from substrate 200. In a preferred embodiment of the invention, substrate 200 is a sheet of metalized, preferably aluminized, polyester having a thickness of between 100 micrometers and 175 micrometers. This material provides substrate 200 with the desired release and support qualities. It should be appreciated, however, that other materials may be equally suitable or more suitable for providing the desired qualities of substrate 200.

Barrier layer 114 is preferably included in image transfer portion 104 in order to isolate the other layers in the image transfer portion from body portion 116, when transfer portion 104 is subsequently integrated with body portion 116, as described below. Such isolation may be required because blanket body 116 may contain materials such as anti-oxidants, anti-ozonants or other additives which may migrate through the upper layers of the blanket, for example as a gas when the blanket is heated during the imaging process and/or in the presence of carrier liquid such as Isopar L. The barrier layer should be substantially impervious to such materials in the blanket body which may migrate and/or to the carrier liquid which is used by the imaging apparatus. If this layer is omitted, under certain circumstances the additive materials can cause deterioration of the photoreceptor used by the imaging apparatus. In particular, it was found that the imaging process may become humidity dependent.

In a preferred embodiment of the invention, a 4–11 micrometer layer of polyvinyl alcohol (88% hydrolyzed) is coated onto surface 202 of substrate 200.

Polyvinyl alcohol, 88% hydrolyzed, having an average molecular weight preferably between 85,000 and 145,000 (Aldrich Chemical Co. Inc., Milwaukee, Wis.) is dissolved in water at 90° C. by continuously stirring the mixture in a reflux system for 30 minutes. After 30 minutes, a quantity of ethanol equal to twice the quantity of water is added to the solution, the resulting polyvinyl alcohol concentration being preferably less than 10%. Higher concentration solutions can be used; however, they give a more viscous solution which is hard to spread evenly.

The solution can be deposited on surface 202 of substrate 200 using a fine wire rod or knife inclined at 30–45° to the direction of movement of the knife or body. The solvent is evaporated either by drying at room temperature or by blowing hot air on the layer.

One or more coating passes are employed to give the required thickness.

Too thin a layer will subsequently result in some penetration of material from body 116 into the layers of portion 104, which is correlated with reduced transfer efficiency from the photoreceptor to the intermediate transfer blanket. This reduced transfer efficiency is believed to be caused by photoreceptor deterioration. While four micrometers of material appears to be sufficient to avoid leaching, a somewhat thicker layer is preferably used.

Other barrier materials and other thicknesses may be used depending on the carrier liquid used for the toner or the gasses omitted by body 116. Other barrier materials may require lesser or greater thickness depending on their resistance to the carrier liquid or the gasses released by body 116. Alternatively, if body 116 resists leaching by the carrier liquid or does not contain materials which are released (especially when body 116 is heated) or any anti-oxidants and/or anti-ozonants, layer 114 may be omitted.

In a preferred embodiment of the invention, barrier layer 114 on substrate 200 is overcoated with soft, conforming, layer 111, formed of polyurethane or a material similar to the material of the very soft layer which is optionally used for layer 126, as described above. Layer 111 is formed by the following process, in accordance with a preferred embodiment of the invention:

One kg of pre-filtered Formez-50 polyester resin (Hagalil Company, Ashdod, Israel) is dehydrated and degassed under vacuum at 60° C. 600 grams of the degassed material is mixed with 1.4 grams of di-butyl-tin-diluarate (Aldrich) and degassed at room temperature for 2 hours. 30 grams of the resulting material, 3.15 grams of RTV Silicone 118 (General Electric) and 4.5 grams of Polyurethane cross-linker, DESMODUR 44V20 (Bayer) are stirred together. A 100 micrometer layer of the material is coated over the preceding layer using a No. 3 wire rod with one or several passes, under clean conditions, preferably, class 100 conditions. The coating may be cured for two hours at room temperature under a clean hood to form a polyurethane layer or may be cured later, together with other layers.

In accordance with a second preferred embodiment of the invention, layer 111 is formed by the following process:

1) 100 g of Hi-Temp 4051 EP (Zeon) acrylic resin is mixed with 2 g NPC-50 crosslinker (Zeon) and 3 g sodium stearate and dissolved in toluene to give a solution of 15% non-volatile solids. Optionally, about 44 g of carbon black Pearls 130 (Cabot) is added.

2) A thin layer of the solution is coated onto the barrier layer and dried. This process is repeated several times until a thickness of preferably 100 micrometers is achieved.

The layer has a Shore A hardness of about 20–24 without carbon black and about 42–45 with carbon black. Softer materials are also suitable; however, substantially harder materials do not adhere well to the drum surface. The acrylic material may be replaced by other soft elastomer materials such as soft nitrile rubber, as described in detail in PCT/NL 95/00188, the disclosure of which is incorporated herein by reference.

Layer 111 which is thus formed should have a resistance of the order of about $10_8$ ohm-cm, good thermal stability at the working temperature of the blanket surface, which is preferably about 100° C. or less.

The function of the conforming layer is to provide good conformation of the blanket to the image forming surface (and the image on the image forming surface) at the low pressures used in transfer of the image from the image forming surface to the blanket. The layer should have a Shore A hardness preferably of between 25 and 65, more preferably between 40 and 50, more preferably between about 42 and 45. While a thickness of 100 micrometers is preferred, other thicknesses, between 50 micrometers and 300 micrometers can be used, with 75 to 125 micrometers being preferred. Too hard a layer can cause incomplete transfer to the intermediate transfer member of very small printed areas, such as single dots. Too soft a layer can cause difficulty in removal of a paper substrate (to which the image is transferred from the intermediate transfer member) from the intermediate transfer member. It is often difficult to achieve optimum transfer and substrate removal.

This problem is partially solved by dividing conforming layer 111 into a number of sub-layers of different hardnesses. The sub-layers may have the same thickness or different thicknesses. This embodiment is based on the discovery that paper removal appears to be most sensitive to the hardness of the upper portion of the layer and that transfer of the image to the transfer blanket is less sensitive to the hardness of this portion of the layer.

Such sub-layers of varying hardness and thickness may be formed in generally the same way as described above with respect to the second method of forming layer 111, with the hardness of the sub-layers being varied by changing the proportion of carbon black. The softer and harder sub-layers are laid down separately to form the total desired thickness of conforming layer 111.

It was found that varying the hardness of the harder layer between 42 and 55 Shore A, the soft layer hardness between 20 and 42 and the thickness of the harder layer between 15 and 30 micrometers (the total layer thickness remaining at 100 micrometers) gave improved paper release properties. The image transfer was improved mainly for the experiments in which the hard layer was thinner and the soft layer softer. The layers are preferably formed such that the harder layer is closest to the upper portion of the layer, and the softer layer closer to the body 116 of the intermediate transfer member. It is believed that thinner hard layers and/or softer soft layers will give even better results.

In a preferred embodiment of the invention, conforming layer 111 is overcoated with release layer 109, which is formed by the following process, according to one preferred embodiment of the invention. 12 grams of RTV silicone 236 (Dow Corning) release material preferably diluted with 2 grams of Isopar L (Exxon) and 0.72 grams of Syl-off 297 (Dow Corning) are mixed together. A wire rod (bar No. 1) coating system is used, with between one and six passes, under clean conditions to achieve a preferably 3–15 micrometer, more preferably 6–12 and most preferably 8–10 micrometer release layer thickness. In practice the release layer is about 8 micrometers thick. The material is cured at room temperature for 2 hours followed by 140° C. for two hours. The cured release material has a resistivity of approximately $10^{14}$ to $10^{15}$ ohm-cm (or a lesser value if a conductive material is added).

According to a second preferred embodiment of the invention, release layer 109 is formed of a condensation type silicone release layer. In general such materials are not used for thin layers, such as the approximately 3–15 micrometer, preferably 8 micrometer layer generally desired for the present invention. However, it has been discovered that when a larger than normal amount of catalyst is added and when the material is preferably cured at an elevated temperature, such materials do cure, even in very thin layers. While generally 0.1%–0.5% of catalyst is normally used, the present invention uses 0.5%–2.5% catalyst preferably greater than 1%. In the preferred embodiment given below, the amount of catalyst is about 2.5 times the maximum normally used.

It has been found that intermediate transfer members using such materials for release layer 109 have generally longer operating lifetime and generally better printing characteristics than blankets formed with release layers according to the prior art. This is also true of blankets in which the image transfer portion is formed directly onto the body as in the prior art. In a preferred embodiment of the invention only reactive silicone compounds are used in the formation of layer 109 with as small an amount of such compounds as silicone oils being present, less than 10%, preferably less than 5% and even more preferably less than 1% of silicone oils being present. Furthermore, it has been found that such materials are generally most useful when they have no fillers, less than 0.1%, or only a small amount of fillers, less than 4%.

Useful materials have been found to include diorganopolysiloxanes terminated at both chain ends with diorganohydroxysilyl groups bonded to terminal silicone atoms work especially well. Finally, it has been found that a mixture of such compounds gives better overall results than individual compounds.

In a preferred embodiment of the invention the release layer 109 is prepared by the following process:

a) 12 Grams of RTV 41 general Electric) is mixed with 16 grams of RTV 11 (General Electric) with the fillers removed (50% solids) and a 250 microliters of an 8:2 solution of Stannous octoate (Sigma) in Isopar H (EXXON).

b) The mixture is coated onto the conforming layer 111 of the blanket using a wire rod and is immediately introduced into an oven at 140° C. for curing for two hours.

The filler material is preferably removed from RTV 11 by dissolving 120 gm of RTV 11 in 80 grams of an Isopar H/Hexane mixture (1:1). The solution is centrifuged at 7000 RPM for one hour.

The resulting material has about 25% filler material, comprising mostly calcium carbonate. A release layer with less filler can be prepared by removing the filler material from the RTV 41 as well.

It has been found that using the individual components of the mixture, namely RTV 41 and RTV 11 by themselves to form release layer 109 also gives an improvement over the prior art. However, the mixture appears to give a greater improvement.

According to a third preferred embodiment, a crosslinker, such as ethyl silicate and conductive material, such as carbon black or anti-static compounds such as CC-42 (Witco) are added to the release layer 109 of the second preferred embodiment of the invention. The added crosslinker provides for further improvement of the mechanical properties and very thin film polymerization of the release layer, while the added conductive material provides for improved electrical characteristics and print quality.

Primers, such as (3-glycidoxypropyl)trimethoxysilane (ABCR, Germany) and 1205 (Dow Corning), are used to provide for maximum adhesion of the release layer 109 to the conforming layer 111.

The release layer 109 of this embodiment is prepared as follows:

a) 100 gm RTV 11 (GE) are dissolved in 100 gm hexane/isopar-H (50:50 by wt.) mixture, 100 gm RTV 41 (GE) are dissolved in 100 gm hexane/isopar-H mixture, and both mixtures are centrifuged at 7000 RPM for 70 min. The liquid is decanted, percent solids determined, and the precipitated solids, comprising filler material, in this case calcium carbonate, from the centrifugation is discarded.

b) An amount of RTV 11 solution which provides 60 gm RTV 11 solids is mixed with an amount of RTV 41 solution which provides 40 gm RTV 41 solids. To this mixture is added 5 gm ethyl silicate (Chordip) and 1 gm Ketjenblack 600 carbon black (Akzo). The mixture is dispersed with a high shear mixer for 10 min.

c) Before the conforming layer 111 of the ITM is coated with the silicone release layer 109, the conforming layer 111 must be coated with the appropriate primers to provide maximum adhesion. Using acrylic rubber as the soft layer of the conforming layer 111, it is first coated with a thin layer of (3-glycidoxypropyl)trimethoxysilane (ABCR, Germany). The primer coated blanket is heated at 50° C. for 5 min. The first primer layer is then coated with a second primer layer of 1205 (Dow Corning), and is left at room temperature for 15 min.

d) To 10 gm of the above-described release material is added 350 microliters of a stannous octoate/isopar-H mixture (4:1 by weight). A dry film thickness of about 7 microns is achieved by 2–3 coatings with a wire rod. Immediately after coating the transfer-portion carrying substrate 104 with the release layer 109, it is placed in an oven at 140° C. for two hours.

Once the formation of image transfer portion 104 on substrate 200 is complete, the transfer-portion carrying substrate is fed to blanket-forming apparatus 180 along the direction indicated by arrow 205. An edge of transfer portion 104 is separated from surface 202 of substrate 200 and collected by a carrier drum 220, which preferably includes a drum having a smooth, preferably metal, surface 222. Surface 222 is preferably formed of very smooth, chrome-coated, stainless steel. Drum 220 preferably rotates in the direction indicated by arrow 210, at a suitable rate, such that surface 222 moves substantially at the same linear velocity as substrate 200.

As shown in FIG. 3, release layer 109 is the upper-most layer coated onto surface 202 of substrate 200 and, thus, layer 109 interfaces surface 222 of drum 220. The generally smooth release layer 109 will temporarily attach itself by a vacuum action to the smooth, metal, surface 222 of drum 220, thereby assisting in the transfer of portion 104 from substrate 200 to intermediate carrier 220, at a first transfer region 203.

As further shown in FIG. 3, the pre-fabricated body portion 116 is fed into a second transfer region 206, between intermediate carrier drum 220 and a lamination drum 212 having a surface 214, along the direction indicated by arrow 215. Drum 212 rotates in a sense opposite that of drum 220, as indicated by arrow 217, such that there is substantially zero relative motion between surfaces 222 and 214 at region 206.

At second transfer region 206, image transfer portion 104 attaches itself to portion 116 and is thus removed from surface 222 of drum 220. Portion 104 is laminated with body portion 116, resulting in the formation of the integrated, multi-layered, image transfer blanket 100.

Lamination of the two portions of blanket 100 is preferably aided by heat and pressure applied by drums 220 and 212. In a preferred embodiment of the invention, drum 220 is heated to a temperature range of between 90° C. and 130° C. Additionally, drum 212 may also be heated. This temperature range should be suitable for aiding bonding between transfer portion 104 and body portion 116, when the materials describes above are used. Bonding is achieved by the uncured conductive layer 115 which becomes highly adhesive in response to the heat applied thereto during lamination.

As mentioned above, conductive layer 115 is preferably not cured prior to lamination. However, the layers in transfer portion 104, i.e. layers 109, 111 and 114, may be cured before lamination, if the conductive layer is formed as part of body portion 116, prior to lamination, as described above. Nevertheless, if conductive layer 115 is included is formed as part of image transfer portion 104, prior to lamination, all the layers in portion 104 are preferably not cured before lamination.

If layer 118 is made conductive (and layer 115 is omitted) then a thin layer of the lacquer of the type used for layer 115 or a glue or a primer may be used over layer 118 to enhance the lamination process.

Once portions 104 and 116 are laminated, the blanket is cured, for example, using a curing device 225. The cured layers include the layers which were not cured prior to lamination, particularly conductive layer 115 and, optionally, uncured layers in image transfer portion 104. Curing device 225 preferably includes a heater as is well known in the art. This completes the formation of multi-layered image transfer blanket 100. Alternatively, strips of blanket may be cured in an oven heated to between 110° C. (for about one hour) and 180° C. (for about four minutes).

Reference is now made to FIG. 4 which schematically illustrates a cross-section of an image transfer blanket 300 having a body portion 216 and an image transfer portion 204, constructed in accordance with another, preferred, embodiment of the present invention. Blanket 300 preferably includes all of the layers described above with reference to FIGS. 1–3, i.e. layers 109, 111, 115, 118, 120, 122 and, optionally, adhesive (or soft) layer 126 of blanket 100 (FIG. 2C). However, in contrast to the integrated blanket 100, image transfer portion 204 of blanket 300 is a self-supporting layer which is not necessarily laminated with body portion 216. Image transfer portion 204 may be permanently or removably attached to body portion 216, using a suitable adhesive, or portion 204 may be used in conjunction with body portion 216 without being attached thereto, for example, as described in detail below. To obtain these features of blanket 300, the active layers of image transfer portion 204 are preferably formed on a thin (including at least the range of 30 micrometers to preferably less than 12 micrometers, with physical stability defining the lower limit of the range) intermediate base layer 250, which is formed of a relatively non-compliant material such as Kapton. Base layer 250 does not contaminate the other layers in transfer portion 204, during formation thereof, and has sufficient strength to support the other layers in portion 204. However, base layer 250 does not obviate the need for body portion 216 which provides, inter alia, high pressure resilience required by multi-layered blanket 300. It is believed that base layer 250 does not substantially affect the operation of body portion 216.

It should be noted that failure of intermediate transfer blankets is caused primarily by failure of the release properties of layer 109. Although, eventually, failure of the blanket may also be caused by failure of the resilient properties of body portion 116, the resilient properties of the body portion last much longer, at least several times longer, than the release properties of the release layer. Thus, the present invention provides a mechanism for replacing only the image transfer portion of blanket 300, as described below.

Reference is now made to FIG. 5 which schematically illustrates an image transfer member 230 using an image transfer blanket, such as blanket 300 of FIG. 4, in which transfer portion 204 is separate from body portion 216. Body portion 216 of blanket 300 is mounted on a drum 240 which rotates in the direction indicated by arrow 235. Body portion 216 may be mounted in a manner similar to that of blanket 100 in the embodiment of FIG. 1, such that only one end of the body portion is secured to a fastener member (not shown) which would be situated at the location indicated by reference numeral 310.

In accordance with the present invention, image transfer member 230 further includes apparatus for replacing image transfer portion 204 of image transfer blanket 300 without replacing body portion 216. The replacement apparatus preferably includes a transfer portion supply member 260, preferably a cassette containing a predetermined length of new, i.e. unused, transfer portion 204, and a take up member 270, preferably a cassette, which collects used transfer portion 204. Transfer portion 204 is preferably tightly stretched over body portion 216, between an aperture 265 of supply member 260 and an aperture 275 of take-up member 270. To ensure that a suitable tension is maintained in transfer portion 204, the transfer portion is preferably locked and/or tensioned at apertures 265 and 275 using any suitable lock/tension devices (not shown), preferably electrically controlled devices. Alternatively, a take-up roller 227 and a pay-out roller 278 are tensioned to assure desired tension in the exposed part of portion 204.

In a preferred embodiment of the invention, take-up member includes a motor-operated take-up roller 277 which collects the used transfer portion 204. Preferably, upon command from a controller (not shown), a predetermined length of transfer portion 204 is collected by take-up roller 277, so as to replace the transfer portion on the entire surface of body portion 216. The controller preferably also controls deactivation of the lock/tension devices at apertures 265 and 275, before replacement of the transfer portion, and reactivation of the lock/tension devices upon completion of the replacement process.

It should be noted that portion 204 is much thinner than body portion 216 and, thus, a longer length of transfer portion may be contained in supply member 260, in comparison to prior art mechanisms which replaced the entire thickness of the blanket. This enables a larger number of replacements of portion 204 before the entire supply of transfer portion 204 in member 260 is used.

Other details of preferred imaging apparatus used in conjunction with the present invention are described in PCT/NL 95/00188, the disclosure of which is incorporated herein by reference.

It should be understood that some aspects of the invention are not limited to the specific type of image forming system used and some aspects of the present invention are also useful with any suitable imaging system which forms a liquid toner image on an image forming surface and, for some aspects of the invention, with powder toner systems. Some aspects of the invention are also useful in systems such as those using other types of intermediate transfer members such as belt or continuous coated drum type transfer members. Some aspects of the invention are suitable for use with offset printing systems. The specific details given above (and in the documents incorporated herein by reference) for the image forming system are included as part of a best mode of carrying out the invention; however, many aspects of the invention are applicable to a wide range of systems as known in the art for electrophotographic and offset printing and copying.

It will be appreciated by persons skilled in the art that the present invention is not limited by the description and example provided hereinabove. Rather, the scope of this invention is defined only by the claims which follow:

What is claimed is:

1. An image transfer member comprising:

a release layer comprising a transfer surface adapted to receive already formed images from a first surface and to transfer them to a second surface; and a conforming layer substantially immediately beneath the release layer which comprises a plurality of sub-layers each having a different Shore A hardness of less than 80.

2. An image transfer member according to claim 1 wherein the sub-layers each have a Shore A hardness of less than 70.

3. An image transfer member according to claim 1 wherein the sub-layers each have a Shore A hardness of less than 60.

4. An image transfer member according to claim 1 wherein the sub-layers each have a Shore A hardness of less than 55.

5. An image transfer member according to claim 4 wherein the plurality of sub-layers comprise at least two sub-layers, a relatively hard one of said sub-layers being situated between the release layer and a relatively softer one of said sub-layers.

6. An image transfer member according to claim 5 wherein the softer layer has a Shore A hardness between 20 and 42.

7. An image transfer member according to claim 6 wherein the harder layer has a Shore A hardness between 42 and 55.

8. An image transfer member according to claim 5 wherein the harder layer has a Shore A hardness between 42 and 55.

9. An image transfer member according to any of claims 1–8 wherein the plurality of sub-layers are comprised of substantially the same material loaded with a stiffener and wherein the differences in hardness are provided by changing the proportion of stiffener.

10. An image transfer member according to claim 9 wherein the stiffener is carbon black.

11. An image transfer member An image transfer member according to any of claims 1–8 wherein the thickness of the harder layer is between about 15 and 30 micrometers.

12. An image transfer member according to claim 11 wherein the thickness of the softer layer is between 70 and 85 micrometers.

13. An image transfer member according to any of claims 1–8 wherein the overall thickness of the plurality of sub-layers is 100 microns.

14. An image transfer member according to any of claims 1–8 wherein the release layer is between 3 and 15 micrometers thick.

15. An image transfer member according to any of claims 1–8 wherein the conforming layer overlays a conductive layer.

16. An image transfer member according to claim 15 wherein the conductive layer has a resistance of between 15K and 50K ohms per square.

17. An image transfer member according to claim 15 including a compressible layer comprising a material formed with internal voids.

18. An image transfer member according to any of claims 1–8 wherein the transfer surface is adapted for transferring toner images.

19. An image transfer member according to any of claims 1–8 wherein the transfer surface is adapted for transferring liquid toner images.

20. An image transfer member according to claim 1 wherein the plurality of sub-layers comprise at least two sub-layers, a relatively harder one of said sub-layers being situated between the release layer and a relatively softer one of said sub layers.

21. An image transfer member according to claim 20 wherein the relatively softer layer has a Shore A hardness of less than 42.

22. An image transfer member according to claim 20 wherein the relatively softer layer has a Shore A hardness of less than 35.

23. An image transfer member according to claim 20 wherein the relatively softer layer has a Shore A hardness of less than 25.

24. An image transfer member according to claim 20 wherein the relatively harder layer has a hardness of greater than 42.

* * * * *